US005735477A

United States Patent [19]

Shore et al.

[11] Patent Number: 5,735,477

[45] Date of Patent: Apr. 7, 1998

[54] STEM COIL PALLET FOR MAKING HALF WEIGHT COILS

[75] Inventors: T. Michael Shore, Princeton; Raymond R. Starvaski, Worcester; Melicher Puchovsky, Dudley, all of Mass.

[73] Assignee: Morgan Construction Company, Worcester, Mass.

[21] Appl. No.: 787,579

[22] Filed: Jan. 22, 1997

[51] Int. Cl.[6] ..... B21C 47/02; B21C 47/24

[52] U.S. Cl. ..... 242/363

[58] Field of Search ..... 242/360, 361, 242/361.1, 361.2, 361.3, 361.4, 361.5, 362, 362.1, 362.2, 362.3, 363

[56] References Cited

U.S. PATENT DOCUMENTS

| | | | |
|---|---|---|---|
| 553,353 | 1/1896 | Morgan | 242/362.2 |
| 3,054,570 | 9/1962 | Nye | 242/363 |
| 3,088,690 | 5/1963 | Haugwitz | 242/363 |
| 3,618,871 | 11/1971 | Gilvar | 242/363 |
| 4,251,037 | 2/1981 | Puchovsky | 242/363 |
| 4,437,620 | 3/1984 | Ozawa | 242/363 |
| 5,501,410 | 3/1996 | Starvaski | 242/361.5 |

*Primary Examiner*—John M. Jillions

*Attorney, Agent, or Firm*—Samuel, Gauthier, Stevens & Reppert

[57] ABSTRACT

In a rolling mill, a reforming chamber is positioned to receive rings of hot rolled steel rod descending along a vertical path from the delivery end of a conveyor onto a support on an underlying carrier. The carrier has an upstanding stem around which the rings accumulate to form a cylindrical coil. First, interceptor elements operate above the carrier to interrupt the descent of rings, and second interceptor elements supported on the carrier beneath the first interceptor elements operate to subdivide the coil being formed around the stem into upper and lower segments, with a gap therebetween occupied by the second intercepting elements.

21 Claims, 6 Drawing Sheets

STEM COIL PALLET FOR MAKING HALF WEIGHT COILS

BACKGROUND OF THE INVENTION

1. Field of the Invention

This invention relates generally to rolling mills where hot rolled steel rod is formed into rings which are subjected to thermal processing while arranged in an overlapping non-concentric pattern on a conveyor, and is concerned in particular with an improvement in the reforming chamber which receives the rings from the delivery end of the conveyor and gathers them into cylindrical coils.

2. Description of the Prior Art

In the conventional reforming chamber, an entire billet length of the rod can either be formed into a single large coil, or the rod can be subdivided into two half weight coils. This subdivision is usually effected by a complicated shear mechanism located in the reforming chamber. Such shear mechanisms are prone to malfunction, are difficult to maintain, and the resulting cuts often produce sharp ends which can create a safety hazard.

SUMMARY OF THE INVENTION

The present invention avoids the aforementioned problems by eliminating the shear mechanism in the reforming chamber, and substituting in its place a much simpler arrangement for physically separating the coil into half weight segments connected by a readily accessible strand which can be severed outside the reforming chamber.

These and other object and advantages of the present invention will become more apparent as the description proceeds with reference to the accompanying drawings, wherein:

DETAILED DESCRIPTION OF THE ILLUSTRATED EMBODIMENTS

Figure 1:
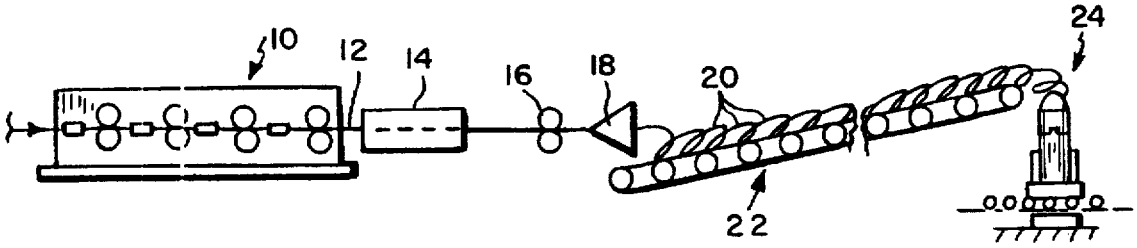
FIG. 1 is a somewhat schematic illustration of the delivery end of a rolling mill including a reforming chamber in accordance with the present invention.

Referring initially to FIG. 1, the delivery end of a rolling mill is shown comprising a finishing block 10 having multiple pairs of work rolls offset one from the other by 90° to produce a hot rolled steel rod 12. The rod is quenched in one or more water boxes 14 before being directed by driven pinch rolls 16 to a laying head 18. The laying head forms the rod into a series of rings 20 which are received in an overlapping non-concentric pattern on a roller conveyor 22. The rings are subjected to thermal processing which typically involves controlled cooling on the conveyor before being delivered to a reforming station generally indicated at 24. At the reforming station, the rings are gathered into cylindrical coils.

Figure 2:
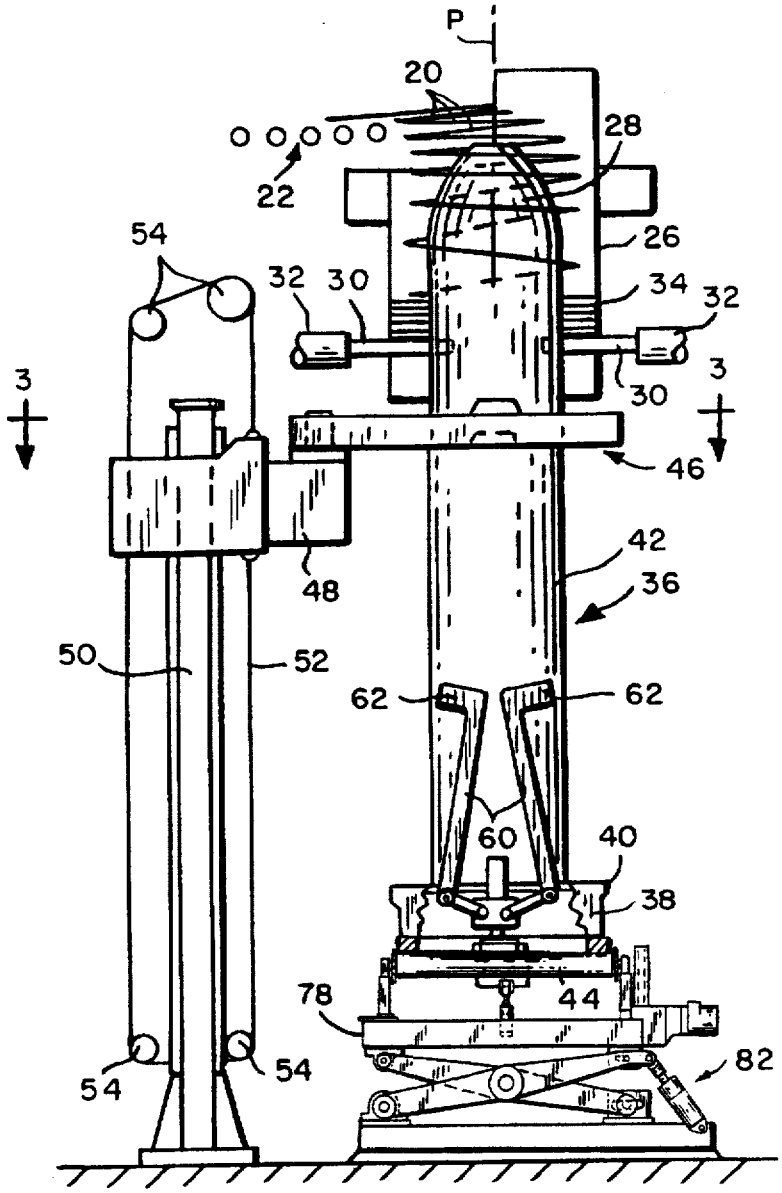
FIG. 2 is an enlarged and more detailed view of the reforming chamber shown in FIG. 1.
Figure 3:
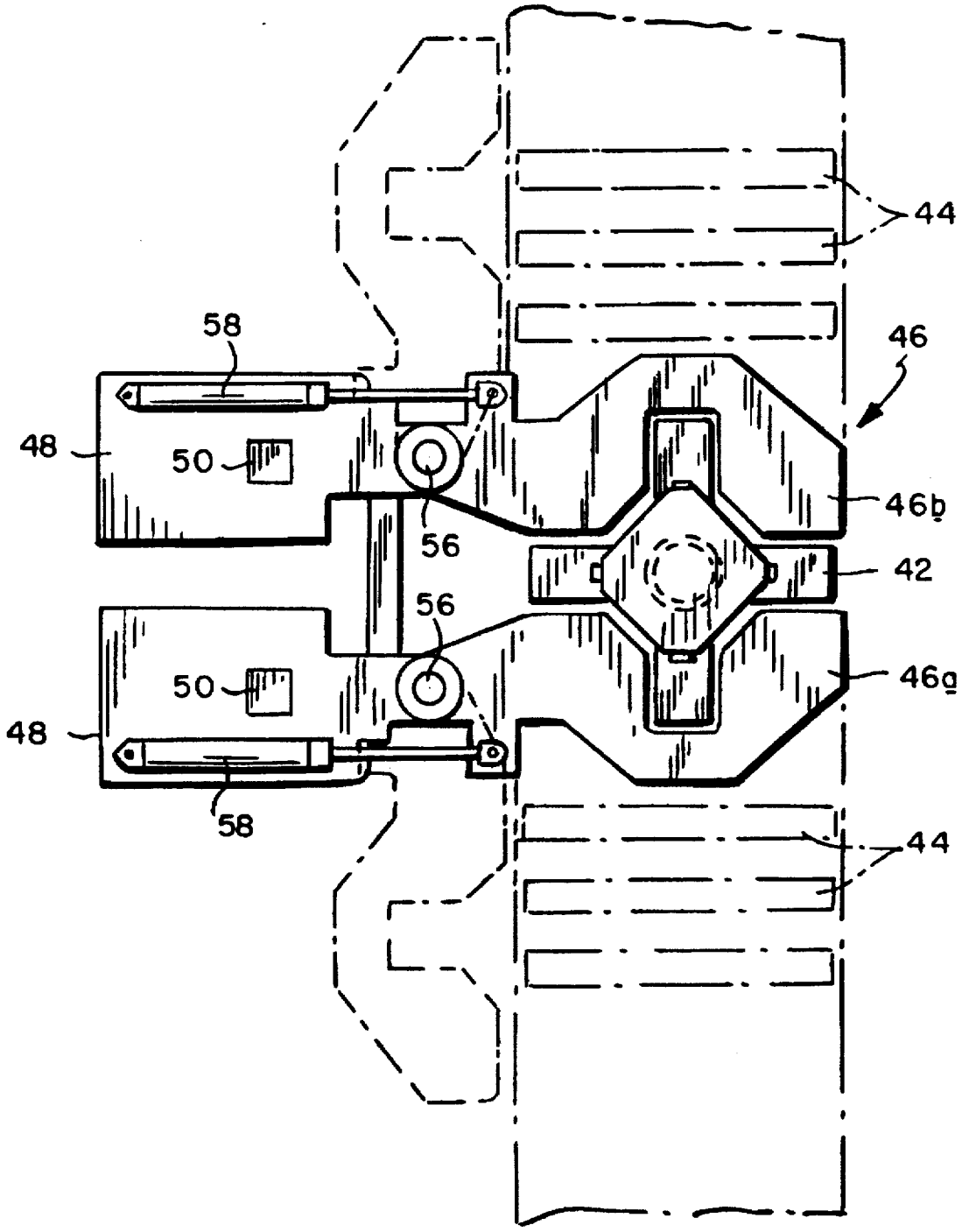
FIG. 3 is a sectional view taken along line 3—3 of FIG. 2.
Figure 4:
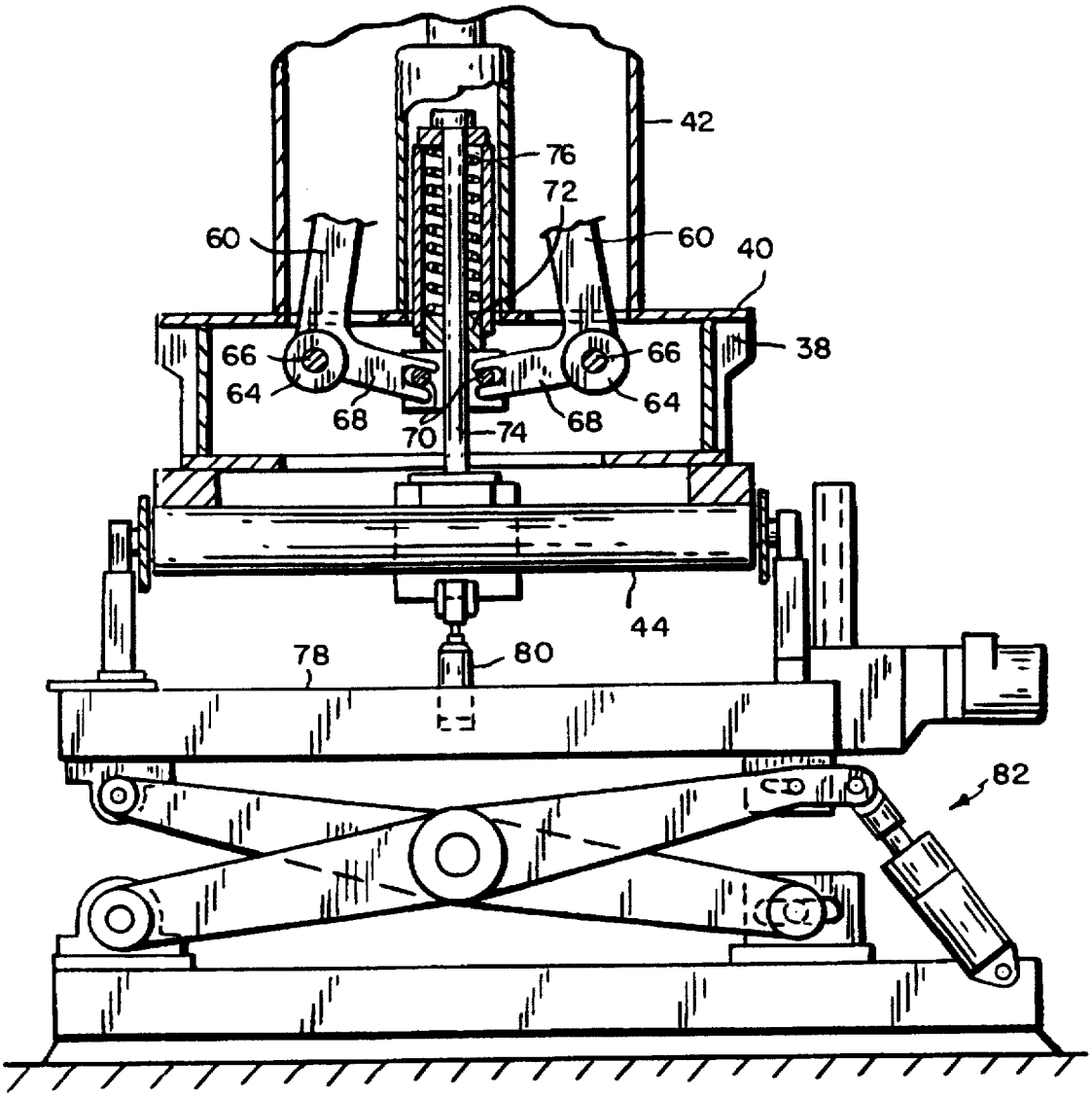
FIG. 4 is an enlarged sectional view illustrating the mechanism for elevating the pallet at the reforming station and for operating the coil dividing arms.

With reference additionally to FIGS. 2–4, it will be seen that the rings 20 descend from the delivery end of the conveyor 22 along a vertical path "P" bounded by a cylindrical chamber wall 26. A centrally disposed mandrel 28 provides initial guidance for the descending rings. At the operational stage illustrated in FIG. 2, the mandrel is supported on first intercepting members 30. The first intercepting members are adjusted by first operating means, herein depicted as piston-cylinder units 32, between operative positions as shown protruding through the chamber wall 26 into the path of ring descent, and retracted positions clear of the path of ring descent. When operatively positioned, the first intercepting members 30 interrupt the descent of rings through the chamber, thus occasioning a temporary accumulation as at 34.

A carrier generally indicated at 36 is located beneath the chamber 26. The carrier includes a pallet 38 defining a coil support surface 40, and a stem 42 protruding vertically from the pallet in axial alignment with the mandrel 28. The carrier is movable into and out of its position beneath the reforming chamber 28 on the rollers 44 of a conventional conveyor. When the carrier 36 is supported on the conveyor rollers 44, as shown in FIG. 2, the upper end of the stem 42 is spaced beneath the bottom end of the mandrel 28. The mandrel 28 is in turn supported by the first intercepting members 30.

A coil plate 46 is carried on an elevator 48, the latter being guided for movement along vertical supports 50. The elevator is raised and lowered in a conventional manner by a system of chains 52 and sprockets 54. As is best shown in FIG. 3, the coil plate is subdivided into two segments **46*a*, 46*b* which are pivotally attached as at 56 to the elevator 48. Piston-cylinder units 58 are employed to pivotally adjust the coil plate segments 46*a*, 46*b* between closed positions surrounding the stem 42** as shown by the solid lines in FIG. 3, and open positions indicated by the broken lines in the same view.

The stem 42 carries second intercepting members in the form of arms 60 having laterally extending fingers 62. As can best be seen in FIG. 4, the lowers ends of the arms 60 terminate in collars 64 rotatably supported on pins 66. The collars 64 have radially extending crank arms 68 which are connected as at 70 to a sleeve 72 having a depending stem 74. The sleeve is biased downwardly by a coiled spring 76, thereby urging the arms 60 into positions inwardly inclined towards the central axis of the stem 42, as shown in FIG. 2, with the fingers 62 being inwardly withdrawn within the cross sectional profile of the stem.

An elevator platform 78 is arranged beneath and provides support for the conveyor rollers 44 at the reforming station. The elevator platform carries a second operating means in the form of a piston-cylinder unit 80, and is vertically adjustable by any known mechanism, for example a conventional scissor jack arrangement generally depicted at 82.

The operation of the apparatus will now be described with additional reference to FIGS. 5A–5J.

Figure 5A:
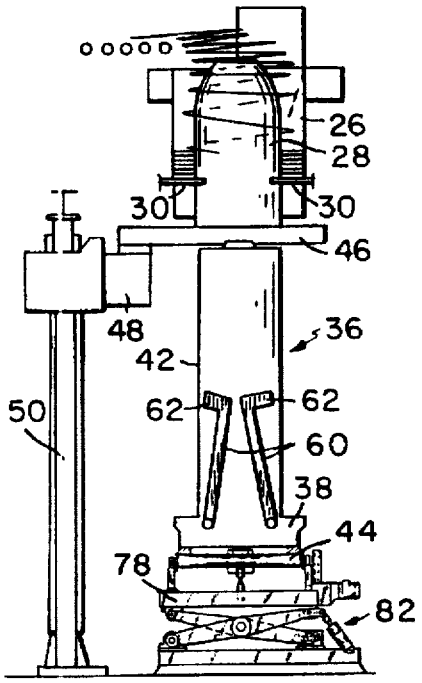
FIG. 5A–5J are schematic illustrations depicting a typical operating cycle of the reforming chamber and associated coil handling equipment.

Beginning at FIG. 5A, which corresponds to the operational stage of the apparatus shown in FIG. 2, the carrier 36 is supported on the conveyor rollers 44, with the elevator platform 78 in a lowered position. The upper end of the stem 42 is spaced beneath the mandrel 28, the latter being supported on the intercepting members 30 with rings temporarily being accumulated thereon around the mandrel and within the chamber wall 26. The coil plate 46 has been elevated to a position closely underlying the intercepting members 30.

Figure 5B:
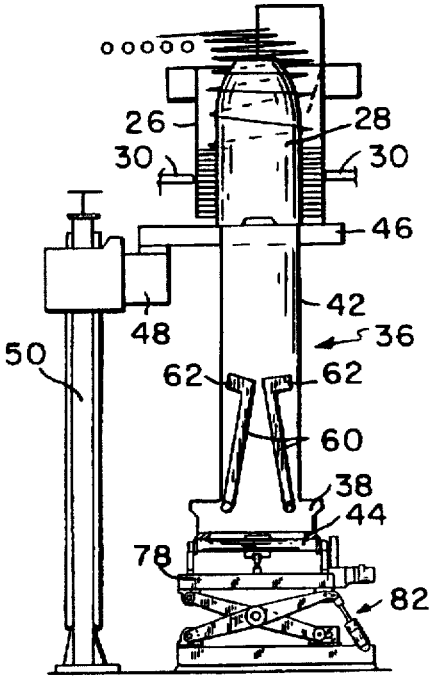

As shown in FIG. 5B, the scissor jack 82 is then operated to raise the pallet 38, thereby placing the upper end of the stem 42 in contact with the lower end of the mandrel 28. The mandrel is now supported on the stem, clearing the way for retraction of the intercepting members 30, and thereby allowing a coil to continue accumulating on the coil plate 46.

Figure 5C:
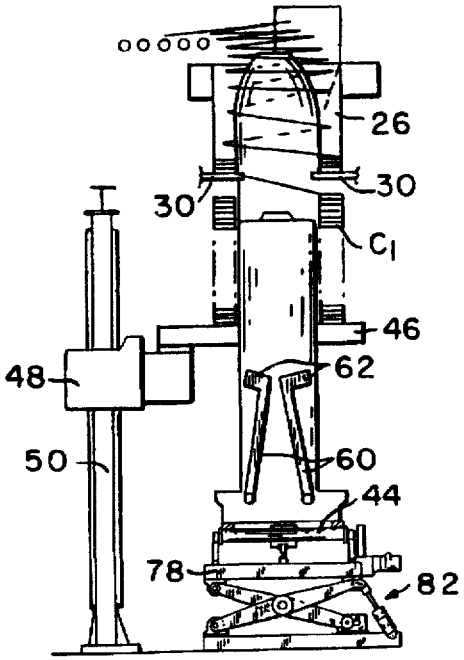

As shown in FIG. 5C, the coil plate 46 is gradually lowered to accommodate the growing height of the coil. This continues until a half coil $C_1$, has been accumulated on the coil plate. At this juncture, the intercepting members 30 are again advanced into the path of ring descent to interrupt further accumulation of rings therebeneath.

Figure 5D:
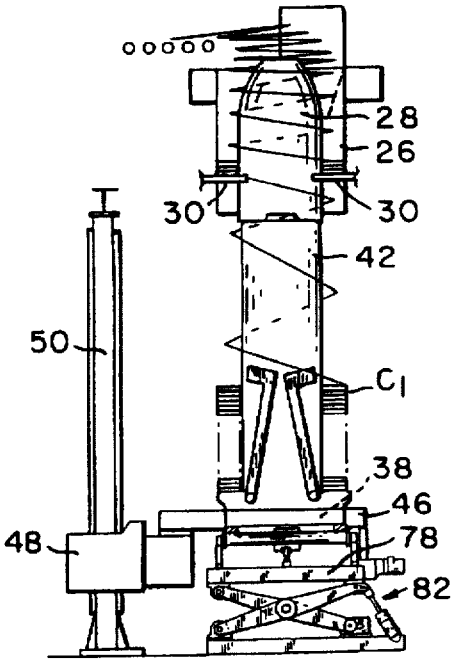

Next, as shown in FIG. 5D, the coil plate 46 is dropped to its lowermost position and its two half segments 46*a*, 46*b* are opened to deposit the half coil $C_1$ on the underlying pallet 38.

Figure 5E:
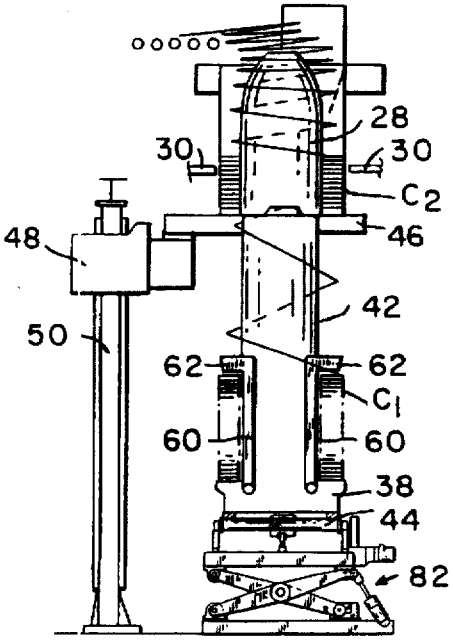

As shown in FIG. 5E, the coil plate 46 is then returned to its raised position, where it is again closed, after which the intercepting members are 30 retracted to allow the second half of the coil $C_2$ to begin accumulating on the coil plate. At the same time, the piston-cylinder unit 80 of the second operating means is actuated to raise the stem 74 against the biasing force of the spring 76, thereby pivoting the arms 60 to operative positions extending substantially parallel to the central axis of the stem, with the fingers 62 now protruding radially outwardly beyond the cross-sectional profile of the stem 42.

Figure 5F:
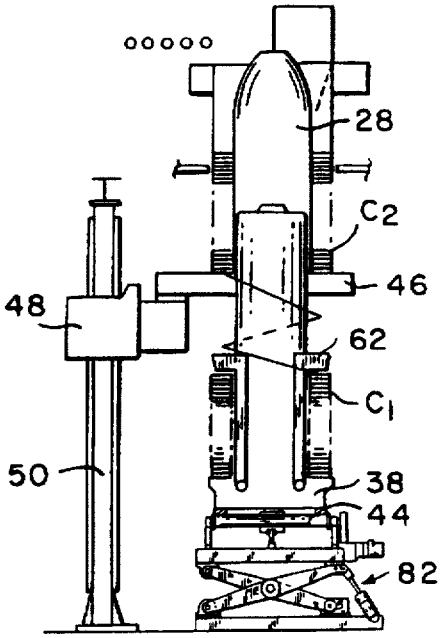
Figure 5G:
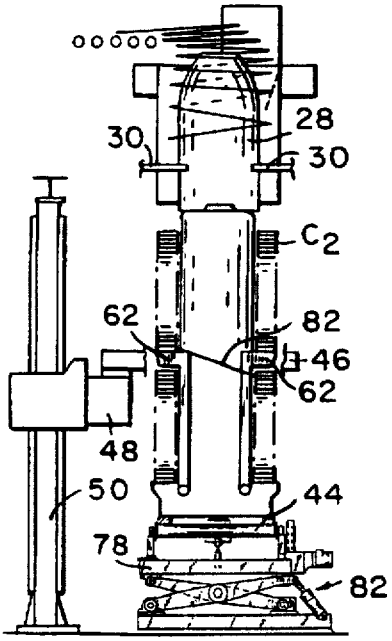

As shown in FIG. 5F, the coil plate 46 is again gradually lowered to accommodate formation of the second coil half $C_2$. When the entire billet length of the rod has been coiled, as shown in FIG. 5G, the intercepting members 30 are again advanced into the path of ring descent, and the coil plate 46 is lowered further to deposit the second half of the coil $C_2$ on the radially outwardly protruding fingers 62. The fingers 62 establish a physical separation between the two coil halves $C_1$, $C_2$, with the only connection therebetween being a single readily accessible strand 82. The piston-cylinder unit 80 is then deactivated. The stem 74 remains raised against the biasing action of the spring 76 due to the weight of the upper coil segment bearing down on the radially extended fingers 62.

Figure 5H:
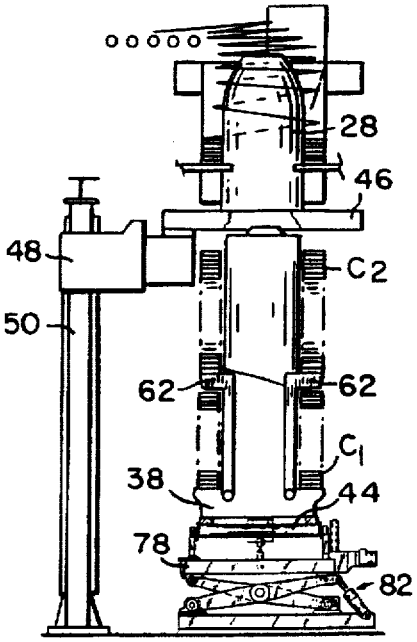
Figure 5I:
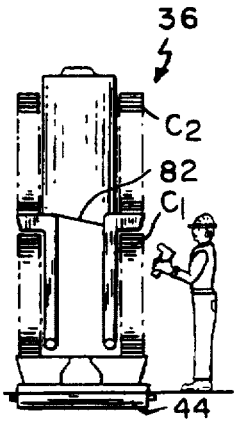
Figure 5J:
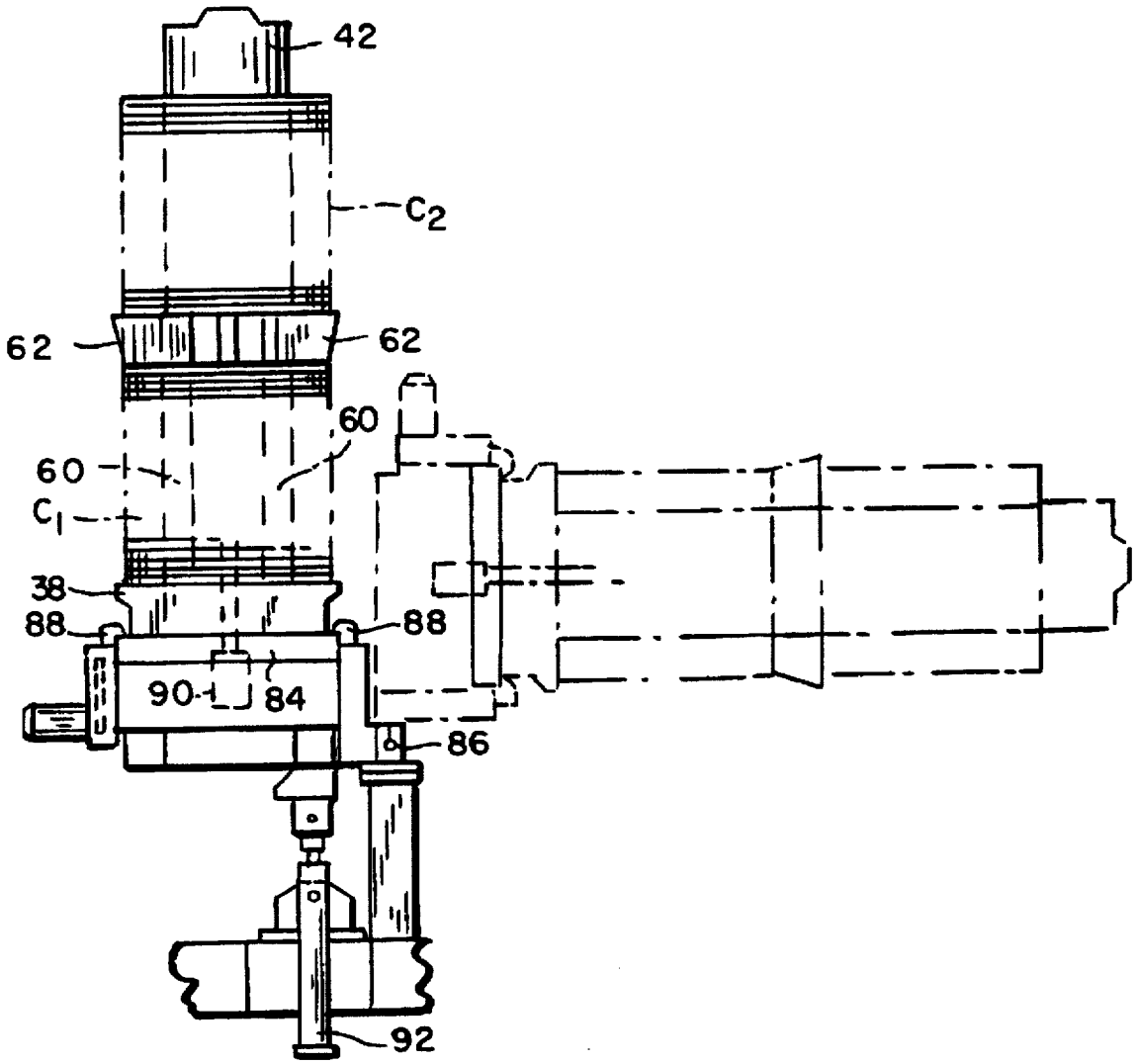

As shown in FIG. 5H, the scissor jack 82 is then actuated to lower the elevator platform 78. The stem 42 drops with the pallet, thereby transferring support of the mandrel 28 back to the intercepting members 30. The coil plate 46 is returned to its uppermost position in preparation for receipt to the next coil half. As is shown in FIG. 5I, the loaded carrier 36 is then transferred away from the coil forming station to a remote location where the connecting strand 82 can be severed by any conventional means, one example being a manually operated shear. From here, the loaded carrier is moved along the conveyor to a downending station depicted in FIG. 5J.

The downending station includes a short roller table section 84 mounted for rotatable movement about an axis 86. The carrier pallet 38 is held down on the roller table section 84 by powered or stationary clamps 88, and a piston cylinder unit 90 similar to unit 80 at the reforming station 24 acts against the stem 74 of the carrier to insure that the arms 60 remain operatively positioned with the fingers 62 positioned between the two half coil segments $C_1$, $C_2$ on the stem 42.

A piston-cylinder unit 92 then acts to rotate the roller table section 84 about axis 86 to the position indicated by the broken lines, thereby placing the stem 42 in a horizontal attitude. Coil half $C_2$ is removed by any convenient means (not shown), after which the piston cylinder unit 90 is deactivated, allowing the arms 60 to collapse inwardly under the force of spring 76. This retracts fingers 62, clearing the way for removal of coil half $C_1$. Thereafter, the roller table section 84 is returned to its original position, and the clamps 88 are released, thereby freeing the carrier to continue along the conveyor back to the reforming station.

While one carrier is being stripped of its coil halves at the downender station, another carrier is already in place at the reforming station where the coil forming cycle is being repeated.

In light of the foregoing, it will now be appreciated by those skilled in the art that the present invention achieves a marked simplification in the design of the reforming chamber. Complicated shears and associated strand locating devices are eliminated in favor of a simple coil dividing and separating mechanism forming part of the coil carrier. The single strand connecting the physically separated coil halves is readily accessible by operating personnel at a location remote from the reforming station.

We claim:

1. In a rolling mill having a reforming chamber through which rings of hot rolled steel rod descend along a vertical path from the delivery end of a conveyor onto a support on an underlying carrier, the carrier having an upstanding stem around which the rings accumulate to form a cylindrical coil, apparatus for subdividing said coil, comprising:

first intercepting members supported independently of said carrier at a level above said support;

first operating means for adjusting said first intercepting members between retracted positions clear of said path and operative positions projecting into said path to interrupt the descent of rings towards said support;

second intercepting members supported on said carrier at a level beneath said first intercepting members; and second operating means for adjusting said second intercepting members between retracted positions clear of said path and operative positions projecting into said path to subdivide said coil into a lower segment comprising the rings previously accumulated therebeneath and an upper segment axially spaced from said lower segment by a gap occupied by said second intercepting members and comprising rings to be subsequently accumulated thereabove following retraction of said first intercepting members to their retracted positions.

2. The apparatus as claimed in claim 1 wherein said second operating means includes means for resiliently biasing said second intercepting members into said retracted positions.

3. The apparatus as claimed in claim 1 wherein said carrier includes a pallet having an upper surface defining said support, and wherein said stem is integrally associated with said pallet and perpendicular to said upper surface.

4. The apparatus as claimed in claim 3 wherein said pallet is carried on a conveyor for movement into and away from a coil receiving station underlying said reforming chamber.

5. The apparatus as claimed in claim 3 wherein said carrier is movable between a location underlying said reforming station and a remote location at which said coil segments are removed therefrom.

6. The apparatus as claimed in claim 5 wherein said coil segments are interconnected by a single rod strand bridging said gap.

7. The apparatus as claimed in claim 6 further comprising means for severing said strand.

8. The apparatus as claimed in claim 3 wherein said second intercepting members comprises arms rotatably mounted on and extending from said pallet along a portion the length of said stem, said arms having laterally extending fingers.

9. The apparatus as claimed in claim 8 wherein said arms are inclined inwardly towards the longitudinal axis of said stem when in said retracted positions, with said laterally extending fingers being inwardly withdrawn within the cross sectional profile of said stem.

10. The apparatus as claimed in claim 9 wherein said arms are parallel to the longitudinal axis of said stem when in said operative positions, with said laterally extending fingers protruding radially outwardly beyond the cross sectional profile of said stem.

11. The apparatus as claimed in claims 9 or 10 wherein said arms are provided with crank members connected to a common driver mounted for reciprocal movement along said axis.

12. The apparatus as claimed in claim 11 wherein said second operating means includes spring means for yieldably urging said driver in one direction to thereby resiliently bias said arm members towards said axis and into said retracted positions.

13. The apparatus as claimed in claim 12 wherein said second operating means includes linear actuator means engageable with said driver for shifting said driver in the opposite direction to overcome the resilient biasing action of said spring means and to thereby rotate said arm members away from said arms and into said operative positions.

14. The apparatus as claimed in claim 10 wherein said laterally extending segments have upper surfaces arranged in a plane perpendicular to the longitudinal axes of said stem when said arms are in said operative positions.

15. The apparatus as claimed in claim 14 wherein said second operating means includes spring means for biasing said arms into said retracted positions, and wherein the weight of said second coil segment bearing on the upper surfaces of said laterally extending segments is sufficient to overcome the biasing action of said spring means.

16. The apparatus as claimed in claim 4 wherein said second operating means includes spring means for yieldably biasing said second intercepting members into said retracted positions, and first linear actuator means selectively operable in opposition to said spring means to adjust said second intercepting members to said operative positions.

17. The apparatus as claimed in claim 16 wherein the weight of said second coil segment acting on said operatively positioned second intercepting members is sufficient to overcome the biasing actions of said spring means.

18. The apparatus as claimed in claim 17 wherein said first linear actuating is fixed with respect to said conveyor.

19. The apparatus as claimed in claim 18 wherein said pallet is movable on said conveyor from said coil receiving station to a coil discharge station.

20. The apparatus as claimed in claim 19 further comprising downender means at said coil discharge station for rotating said pallet 90° to place said stem in a horizontal disposition.

21. The apparatus as claimed in claim 20 further comprising second linear actuator means associated with said downender means, said second linear actuator means being selectively operable in opposition to said spring means to retain said second intercepting members in said operative positions.

* * * * *